US011224890B2

(12) United States Patent
Kuribayashi et al.

(10) Patent No.: US 11,224,890 B2
(45) Date of Patent: Jan. 18, 2022

(54) METHOD FOR PRODUCING RARE-EARTH MAGNETS, AND RARE-EARTH-COMPOUND APPLICATION DEVICE

(71) Applicant: SHIN-ETSU CHEMICAL CO., LTD., Tokyo (JP)

(72) Inventors: Yukihiro Kuribayashi, Echizen (JP); Shogo Kamiya, Echizen (JP); Harukazu Maegawa, Echizen (JP); Shintaro Tanaka, Echizen (JP)

(73) Assignee: SHIN-ETSU CHEMICAL CO., LTD., Tokyo (JP)

( * ) Notice: Subject to any disclaimer, the term of this patent is extended or adjusted under 35 U.S.C. 154(b) by 0 days.

(21) Appl. No.: 15/570,243

(22) PCT Filed: Apr. 18, 2016

(86) PCT No.: PCT/JP2016/062194
§ 371 (c)(1),
(2) Date: Oct. 27, 2017

(87) PCT Pub. No.: WO2016/175061
PCT Pub. Date: Nov. 3, 2016

(65) Prior Publication Data

US 2018/0141072 A1 May 24, 2018

(30) Foreign Application Priority Data

Apr. 28, 2015 (JP) ..... JP2015-091993

(51) Int. Cl.
*B05D 1/28* (2006.01)
*B05B 13/02* (2006.01)
(Continued)

(52) U.S. Cl.
CPC ..... *B05B 13/0221* (2013.01); *B05D 3/02* (2013.01); *B22F 3/00* (2013.01); *B22F 3/24* (2013.01);
(Continued)

(58) Field of Classification Search
CPC .. H01F 41/0293; H01F 41/0253; H01F 17/02; H01F 1/053; H01F 1/0536;
(Continued)

(56) References Cited

U.S. PATENT DOCUMENTS 3,523,040 A 8/1970 Lee
4,949,667 A 8/1990 Yoshida et al.
(Continued)

FOREIGN PATENT DOCUMENTS

CN 101145424 A 3/2008
CN 102483980 A 5/2012
(Continued)

OTHER PUBLICATIONS

International Search Report for PCT/JP2016/062194 (PCT/ISA/210) dated Jul. 19, 2016.
(Continued)

*Primary Examiner* — Tabassom Tadayyon Eslami
(74) *Attorney, Agent, or Firm* — Birch, Stewart, Kolasch & Birch, LLP

(57) ABSTRACT

When a slurry s obtained by dispersing a rare-earth-compound powder in a solvent is applied to sintered magnet bodies m, and dried to remove the solvent in the slurry and cause the surfaces of the sintered magnet bodies to be coated with the powder, and the sintered magnet bodies coated with the powder are heat treated to cause the rare-earth element to be absorbed by the sintered magnet bodies, the sintered magnet bodies m are warmed or heated before the slurry s is applied. As a result, the rare-earth-compound powder can
(Continued)

be efficiently and uniformly applied to the surfaces of the sintered magnet bodies.

10 Claims, 2 Drawing Sheets

(51) Int. Cl.

| | |
|---|---|
| ***B22F 3/24*** | (2006.01) |
| ***B22F 3/00*** | (2021.01) |
| ***B05D 3/02*** | (2006.01) |
| ***C22C 38/00*** | (2006.01) |
| ***H01F 1/053*** | (2006.01) |
| ***H01F 1/057*** | (2006.01) |
| ***H01F 1/08*** | (2006.01) |
| ***H01F 41/02*** | (2006.01) |
| *B05D 1/02* | (2006.01) |

(52) U.S. Cl.
CPC ..... *C22C 38/00* (2013.01); *H01F 1/053* (2013.01); *H01F 1/057* (2013.01); *H01F 1/0536* (2013.01); *H01F 1/086* (2013.01); *H01F 41/0293* (2013.01); *B05D 1/02* (2013.01); *B22F 2003/248* (2013.01); *H01F 1/0577* (2013.01)

(58) Field of Classification Search
CPC ..... H01F 7/02; H01F 41/24; H01F 4/0293; B05D 3/0218; B05D 3/0227; B05D 1/28; B05B 13/0221; B05B 3/00
USPC ... 428/822.3, 822.5, 822.4, 694 LE, 694 RE; 427/128, 130, 131, 129, 127, 132, 314, 427/372.2, 211, 428.2, 194
See application file for complete search history.

(56) References Cited

U.S. PATENT DOCUMENTS

| | | | | |
|---|---|---|---|---|
| 5,049,453 | A * | 9/1991 | Suemitsu | C23C 2/285 428/629 |
| 5,869,148 | A * | 2/1999 | Silverschotz | H01F 41/16 427/549 |
| 7,559,996 | B2 | 7/2009 | Miyata et al. | |
| 8,377,233 | B2 | 2/2013 | Nakamura et al. | |
| 2002/0160231 | A1* | 10/2002 | Schneider | G11B 5/70 428/843 |
| 2007/0151632 | A1 | 7/2007 | Komuro et al. | |
| 2008/0054736 | A1 | 3/2008 | Miyata et al. | |
| 2008/0245442 | A1* | 10/2008 | Nakamura | B22F 9/023 148/101 |
| 2009/0322459 | A1* | 12/2009 | Nagata | C23C 14/18 335/302 |
| 2011/0293950 | A1* | 12/2011 | Kim | B05D 5/08 428/447 |
| 2012/0139388 | A1* | 6/2012 | Iwasaki | B22F 3/24 310/254.1 |
| 2013/0271248 | A1 | 10/2013 | Nagata et al. | |

FOREIGN PATENT DOCUMENTS

| | | | | |
|---|---|---|---|---|
| CN | 103205142 | A | | 7/2013 |
| CN | 103854819 | A | | 6/2014 |
| JP | 02-081661 | U | | 6/1990 |
| JP | 3-118873 | | * | 5/1991 |
| JP | 09-180920 | A | | 7/1997 |
| JP | H09-180920 | | * | 7/1997 |
| JP | H09-180920 | | * | 9/1997 |
| JP | 52-130019 | | * | 11/1997 |
| JP | H10-124866 | | * | 5/1998 |
| JP | 2013-236071 | | * | 11/2013 |
| JP | 2013-236071 | A | | 11/2013 |
| WO | WO 2006/043348 | A1 | | 4/2006 |
| WO | WO 2011/108704 | A1 | | 9/2011 |

OTHER PUBLICATIONS

Written Opinion of the International Searching Authority for PCT/JP2016/062194 (PCT/ISA/237) dated Jul. 19, 2016.
Japanese Office Action dated Apr. 3, 2018, issued in the corresponding Japanese Patent Application No. 2015-091993, with machine English translations thereof.
European Patent Office Communication and extended search report issued in the corresponding European Patent Application No. 16786338.0 dated Dec. 20, 2018.
Chinese Office Action and Search Report dated May 7, 2019, for corresponding Chinese Application No. 201680023908.1.
Chinese Office Action and Search Report for Chinese Application No. 201680023908.1, dated Feb. 3, 2020.

* cited by examiner

METHOD FOR PRODUCING RARE-EARTH MAGNETS, AND RARE-EARTH-COMPOUND APPLICATION DEVICE

TECHNICAL FIELD

The present invention relates to a production method of rare earth magnets, which, upon production of the rare earth permanent magnets by coating sintered magnet bodies with a powder of one or more rare earth compounds and subjecting the resulting sintered magnet bodies to heat treatment to cause absorption of one or more rare earth elements into the sintered magnet bodies, can uniformly and efficiently coat the powder of the one or more rare earth compounds to efficiently obtain rare earth magnets having excellent magnetic properties, and also to a coating device for coating application of one or more rare earth compounds, which can be preferably used in the production method of the rare earth magnets.

BACKGROUND ART

Rare earth permanent magnets, such as Nd—Fe—B, are finding ever widening applications for their excellent magnetic properties. As a method for providing such rare earth magnets with further improved coercivity, it is known to obtain rare earth permanent magnets by coating surfaces of sintered magnet bodies with a powder of one or more rare earth compounds and subjecting the resulting sintered magnet bodies to heat treatment to cause absorption and diffusion of one or more rare earth elements into the sintered magnet bodies (Patent Document 1: JP-A 2007-53351, Patent Document 2: WO 2006/043348). According to this method, it is possible to enhance coercivity while reducing a decrease in remanence.

However, there is still room for further improvements in above-described method. Specifically, for the coating application of such rare earth compound or compounds, it has been a conventional common practice to coat sintered magnet bodies with a slurry, in which a powder of the rare earth compound or compounds is dispersed in water or an organic solvent, by dipping the sintered magnet bodies in the slurry or spraying the slurry onto the sintered magnet bodies, and then to dry the resulting sintered magnet bodies. Nonetheless, this conventional practice can hardly conduct uniform coating to sintered magnet bodies and is prone to variations in coating thickness. Further, the denseness of coating is not high so that an excessively large coat weight is needed for increasing the coercivity to saturation.

It is, accordingly, desired to develop a coating method that enables uniform and efficient coating application of a powder of one or more rare earth compounds.

PRIOR ART DOCUMENTS

Patent Documents

Patent Document 1: JP-A 2007-53351
Patent Document 2: WO 2006/043348

SUMMARY OF THE INVENTION

Problems to be Solved by the Invention

With the above circumstances in view, the present invention has, as objects thereof, the provision of a production method of rare earth magnets, which, upon production of rare earth permanent magnets by coating sintered magnet bodies of an $R^1$—Fe—B composition ($R^1$ is one or more elements selected from rare earth elements including Y and Sc) with a slurry, in which a powder of one or more compounds selected from oxides, fluorides, oxyfluorides, hydroxides and hydrides of $R^2$ ($R^2$ is one or more elements selected from rare earth elements including Y and Sc) is dispersed in a solvent, drying the resulting sintered magnet bodies to deposit the powder on surfaces of the sintered magnet bodies, and subjecting the resulting sintered magnet bodies to heat treatment to cause absorption of $R^2$ into the sintered magnet bodies, can perform uniform and efficient coating application of the powder, can control the coat weight to form dense coatings of the powder with good adhesion, and can efficiently obtain rare earth magnets of still better magnetic properties, and also a coating device for coating application of the one or more rare earth compounds, which can be suitably used in the production method of the rare earth magnets.

Means for Solving the Problems

To achieve one of the above-described objects, the present invention provides the following production methods [1] to [9] of rare earth magnets.

[1] A method for producing rare earth magnets by coating sintered magnet bodies of an $R^1$—Fe—B composition ($R^1$ is one or more elements selected from rare earth elements including Y and Sc) with a slurry in which a powder of one or more compounds selected from oxides, fluorides, oxyfluorides, hydroxides and hydrides of $R^2$ ($R^2$ is one or more elements selected from rare earth elements including Y and Sc) is dispersed in a solvent, drying the resulting sintered magnet bodies to remove the solvent from the slurry and to coat surfaces of the sintered magnet bodies with the powder, and subjecting the resulting sintered magnet bodies to heat treatment to cause absorption of $R^2$ into the sintered magnet bodies, the method including:

warming or heating the sintered magnet bodies before the coating of the slurry.

[2] The production method of [1], in which the warming or heating of the sintered magnet body is conducted at up to a temperature lower by 20° C. than a boiling point of the solvent in the slurry.

[3] The production method of [2], in which the solvent in the slurry is water, and the sintered magnet bodies are coated with the slurry after warming or heating the sintered magnet bodies to 40° C. to 80° C.

[4] The production method of any one of [1] to [3], in which the warming or heating is conducted by radiating infrared rays to the sintered magnet bodies.

[5] The production method of [4], in which the infrared rays are near infrared rays of 0.8 to 5 μm wavelength.

[6] The production method of any one of [1] to [5], in which the coating of the slurry is conducted by roll coating.

[7] The production method of any one of [1] to [6], in which a coating process of warming or heating the sintered magnet bodies, coating the resulting sintered magnet bodies with the slurry, and drying the resulting sintered magnet bodies is repeated a plurality of times to conduct recoating.

[8] The production method of any one of [1] to [7], in which the heat treatment is applied to each sintered magnet body, which has been coated with the powder, in vacuo or in an inert gas at a temperature up to a sintering temperature for the sintered magnet body.

[9] The production method of any one of [1] to [8], further including:

applying, after the heat treatment, aging treatment at a further low temperature.

To achieve the above object, the present invention also provides the following coating devices [10] to [15] of one or more rare earth compounds.

[10] A device for coating, with one or more rare earth compounds selected from oxides, fluorides, oxyfluorides, hydroxides and hydrides of $R^2$ ($R^2$ is one or more elements selected from rare earth elements including Y and Sc), rectangular plate or block, sintered magnet bodies of an $R^1$—Fe—B composition ($R^1$ is one or more elements selected from rare earth elements including Y and Sc) by coating the sintered magnet bodies with a powder of one or more rare earth compounds upon production of rare earth permanent magnets by coating the sintered magnet bodies with a slurry of the powder dispersed in a solvent, drying the resulting sintered magnet bodies to coat surfaces of the sintered magnet bodies with the powder, and subjecting the resulting sintered magnet bodies to heat treatment to cause absorption of $R^2$ into the sintered magnet bodies, the device including:

a transport conveyor that transports the sintered magnet bodies placed thereon;

slurry coating means that coats, with the slurry, the sintered magnet bodies on the transport conveyor;

preheater means that is disposed on a side upstream of a position, where the slurry is coated by the coating means, as viewed in a transport direction and warms or heats the sintered magnet bodies on the transport conveyor to a predetermined temperature; and dryer means that is disposed on a side downstream of the position, where the slurry is coated by the coating means, as viewed in the transport direction and warms and dries the sintered magnet bodies on the transport conveyor, in which the sintered magnet bodies are fed and transported from an upstream side of the transport conveyor, and are warmed or heated to the predetermined temperature by the preheater means, the sintered magnet bodies which have been warmed or heated to the predetermined temperature are coated with the slurry by the slurry coating means, the sintered magnet bodies which have been coated with the slurry are dried under heat by the dryer means to remove the solvent from the slurry, whereby the powder is deposited on the surfaces of the sintered magnet bodies; and the resulting sintered magnet bodies are collected from a downstream side of the transport conveyor.

[11] The coating device of [10], in which the preheater means conducts warming or heating by radiating infrared rays with an infrared heater.

[12] The coating device of [10] or [11], in which the dryer means is provided with an infrared heater that conducts heating by radiating infrared rays to the sintered magnet bodies, and exhaust means that removes the solvent, which has been vaporized by radiation of infrared rays, from around the sintered magnet bodies.

[13] The coating device of [11] or [12], in which the infrared heater of one or each of the preheater means and the dryer means radiates near infrared rays of 0.8 to 5 μm wavelength.

[14] The coating device of any one of [10] to [13], in which the slurry coating means coats the sintered magnet bodies at surfaces thereof with the slurry by a coating roll.

[15] The coating device of any one of [10] to [14], further including:

cleaning means disposed on the side upstream of the position, where the slurry is coated by the slurry coating means, as viewed in the transport direction, whereby a laminar air flow is blown from an air knife to clean the surfaces of the sintered magnet bodies.

Upon depositing the powder of the rare earth compound or compounds on the surfaces of the sintered magnet bodies by coating the sintered magnet bodies with the slurry, in which the powder is dispersed, and drying the resulting sintered magnet bodies to remove the solvent from the slurry, the production method and the coating device according to the present invention, as described above, warm or heat the sintered magnet bodies to the predetermined temperature before coating them with the slurry, coat the warmed or heated, sintered magnet bodies with the slurry, and drying the resulting sintered magnet bodies to form coatings of the powder of the rare earth compound or compounds. By warming or heating the sintered magnet bodies before the slurry coating as described above, the drying can be completed in an extremely short time upon drying under heat after the slurry coating. As the solvent can be almost instantaneously evaporated from the slurry to dry the sintered magnet bodies in some instances, uniform coatings can be formed efficiently and surely without forming drips of the slurry.

Further, for example, as in the claims 6 and 14 described above, the application amount of the powder which contains the valuable rare earth compound or compounds can be effectively reduced by roll-coating the slurry so that slurry coating is locally applied only to necessary parts of the sintered magnet bodies according to the manner of use of the resulting magnets and coatings are locally formed on the necessary parts. According to the present invention, the drying after the slurry coating can be completed in an extremely short time as described above. It is, therefore, possible to prevent, as much as possible, drips of the slurry, for example, onto side surfaces where increased coercivity is not needed, to avoid wasteful consumption of the powder that contains the valuable rare earth compound or compounds, and to achieve an increase in coercivity extremely efficiently.

Furthermore, as in the claims 4, 5, 11, and 13 described above, by conducting the preheating (prewarming) before the slurry coating and the drying under heat after the coating through radiation of infrared rays, especially through radiation heating that radiates short-wavelength, near infrared rays of 0.8 to 5 μm wavelength, it is possible to conduct the preheating (prewarming) and drying under heat efficiently in a short time, further to surely obtain uniform coatings of the above-described powder without developing cracking, and still further to achieve downsizing of the coating device.

Described specifically, the heater that radiates short-wavelength, near infrared rays of 0.8 to 5 μm wavelength has a fast temperature rise, can begin effective heating in one to two seconds, can heat to 100° C. in ten seconds, and can complete heating or warming in an extremely short time. In addition, the above-described heater can be configured at lower cost than conducting induction heating, and is also advantageous from the standpoint of power consumption. Therefore, the coating of the powder can be conducted by drying the slurry at lower cost and efficiently. Furthermore, according to the radiation heating by the radiation of near infrared rays, the near infrared rays can be also transmitted and absorbed into the coatings of the slurry to conduct heating or warming. It is, therefore, possible to avoid, as much as possible, development of cracking which would otherwise occur because of the beginning of drying from the outer sides of the coatings as in a case that heating/warming or drying is conducted, for example, by blowing hot air from the outside, and to form uniform and dense coatings of the powder.

In addition, a heater tube that emits the above-described near infrared rays of short wavelength is relatively small, and can downsize the dryer, and hence the coating device, thereby making it possible to efficiently produce rare earth magnets by small-scale facilities. The use of mid-wavelength infrared rays can also achieve a high heating speed, but requires a long heater tube, is very disadvantageous from the standpoint of space saving, and tends to result in inferiority from the standpoint of power consumption.

Advantageous Effects of the Invention

According to the present invention, uniform and dense coatings made from a powder of one or more rare earth compounds can be surely formed by coating sintered magnet bodies with a slurry, in which the powder of the rare earth compound or compounds are dispersed, and efficiently drying the resulting sintered magnet bodies. Therefore, control of the coat weight can be precisely conducted, so that irregularity-free, uniform and dense coatings of the powder of the rare earth compound or compounds can be efficiently formed on surfaces of the sintered magnet bodies. Moreover, a coating device for coating application of the rare earth compound or compounds, the coating device being used upon practicing the above-mentioned coating steps, can be downsized.

According to the production method and the coating device of the present invention, a powder of one or more rare earth compounds can be uniformly and densely coated on surfaces of sintered magnet bodies as described above, and therefore rare earth magnets can be efficiently produced with favorably increased coercivity and excellent magnetic properties.

BRIEF DESCRIPTION OF THE DIAGRAMS

EMBODIMENT FOR CARRYING OUT THE INVENTION

Figure 1:
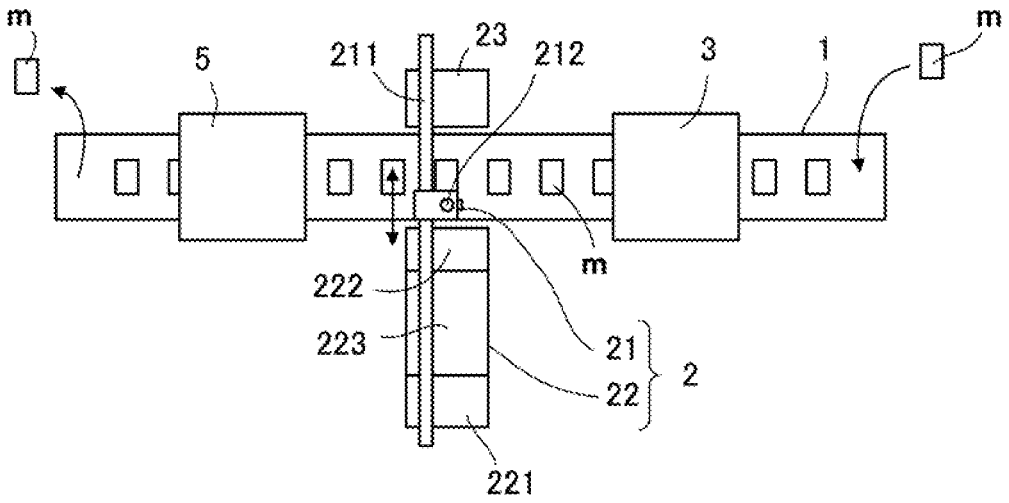
FIG. 1 is a schematic plan view illustrating a coating device according to an embodiment of the present invention for coating application of one or more rare earth compounds.

As described above, the production method of the present invention for rare earth magnets produces the rare earth permanent magnets by coating sintered magnet bodies of an $R^1$—Fe—B composition ($R^1$ is one or more elements selected from rare earth elements including Y and Sc) with a slurry, in which a powder of one or more compounds selected from oxides, fluorides, oxyfluorides, hydroxides and hydrides of $R^2$ ($R^2$ is one or more elements selected from rare earth elements including Y and Sc) is dispersed in a solvent, drying the resulting sintered magnet bodies to deposit the powder on surfaces of the sintered magnet bodies, and subjecting the resulting sintered magnet bodies to heat treatment to cause absorption of $R^2$ into the sintered magnet bodies.

As the $R^1$—Fe—B sintered magnet bodies, those which have been obtained by a known method can be used. For example, the $R^1$—Fe—B sintered magnet bodies can be obtained by subjecting a mother alloy, which contains $R^1$, Fe and B, to coarse milling, fine pulverizing, forming and sintering in accordance with a usual method. It is to be noted that $R^1$ is, as described above, one or more elements selected from rare earth elements including Y and Sc, specifically one or more rare earth elements selected from Y, Sc, La, Ce, Pr, Nd, Sm, Eu, Gd, Tb, Dy, Ho, Er, Yb and Lu can be mentioned.

In the present invention, the $R^1$—Fe—B sintered magnet bodies are formed into a predetermined shape by grinding as needed, are coated at the surfaces thereof with the powder of the one or more of the oxides, fluorides, oxyfluorides, hydroxides and hydrides of $R^2$, and are then subjected to heat treatment to cause absorptive diffusion (grain boundary diffusion) of $R^2$, whereby rare earth magnets are obtained.

$R^2$ is, as described above, one or more elements selected from rare earth elements including Y and Sc, and similar to $R^1$, one or more rare earth elements selected from Y, Sc, La, Ce, Pr, Nd, Sm, Eu, Gd, Tb, Dy, Ho, Er, Yb and Lu can be exemplified. Here, $R^2$ may include, but is not specifically limited to include, preferably at least 10 at %, more preferably at least 20 at %, notably at least 40 at % of Dy or Tb in total as the one or more rare earth elements. It is preferred from the objects of the present invention that at least 10 at % of Dy and/or Tb is included in $R^2$ as described above and the total concentration of Nd and Pr in $R^2$ is lower than the total concentration of Nd and Pr in $R^1$.

In the present invention, the coating of the powder is conducted by preparing a slurry with the powder dispersed in a solvent, coating surfaces of sintered magnet bodies with the slurry, and drying the resulting sintered magnet bodies. Here, the powder is not limited to any particular particle size, and may have a particle size that is common as a powder of one or more rare earth compounds for use in absorptive diffusion (grain boundary diffusion). Specifically, the average particle size may be preferably up to 100 μm, with up to 10 μm being more preferred. No particular limitation is imposed on its lower limit although at least 1 nm is preferred. This average particle size can be determined as a mass average particle size $D_{50}$ (specifically, a particle size or median size at 50% cumulative mass), for example, by using a particle size distribution analyzer that relies upon laser diffractometry. The solvent in which the powder is to be dispersed may be water or an organic solvent. As the organic solvent, no particular limitation is imposed, and ethanol, acetone, methanol, isopropanol can be exemplified. Among these, ethanol is suitably used.

No particular limitation is imposed on the amount of the powder dispersed in the slurry. In the present invention, however, it is preferred to prepare a slurry with the amount of the dispersed powder being set at a mass fraction of at least 1%, notably at least 10%, specifically at least 20% for good and efficient deposition of the powder. As an unduly great dispersed amount causes inconvenience such as unavailability of a uniform dispersion, the upper limit may be set at a mass fraction of preferably up to 70%, notably up to 60%, specifically up to 50%.

As the method that coats the slurry on the sintered magnet bodies, no particular limitation is imposed, and a suitable method can be chosen as desired. For example, a dipping method that dips sintered magnet bodies in a slurry, a spray method that sprays and coats a slurry, or a roll coating method that coats a slurry by rolling a coating roll, which has been impregnated with the slurry, on surfaces of sintered magnet bodies can be appropriately adopted. Among these, the roll coating method can easily conduct localized coating compared with the dipping method or spraying method, so that the roll coating method can be appropriately adopted if a part or parts where increased coercivity is required is/are localized. According to the roll coating method, uniform coating of a slurry can be locally conducted only to each necessary location.

In the present invention, the sintered magnet bodies are warmed beforehand by warming or heating the sintered magnet bodies to a predetermined temperature before the slurry coating as mentioned above. Here, the warming or heating temperature for the sintered magnet bodies may normally be, but is not particularly limited to, a temperature lower than the boiling temperature of the solvent used to prepare the slurry, and preferably, may be set at up to a temperature lower by 20° C. than the boiling point of the solvent. If a slurry is prepared using water as a solvent, for example, it is preferred to warm or heat the sintered magnet bodies to a temperature of up to 80° C. It is to be noted that there is no particular lower limit to the warming or heating temperature. If warmed or heated to at least room temperature, the above-mentioned advantageous effects of the present invention can be obtained, but the degrees of these advantageous effects vary depending on the kind of the solvent in the slurry. Under an environment of room temperature ranging of 20° C. to 25° C., for example, the use of water as a solvent can obtain the advantageous effects to a significant level if warmed to 30° C., and to a very substantial level if warmed or heated to at least 40° C. Although not particularly limited, warming or heating to 40° C. to 80° C. is preferred if water is used as a solvent.

The present invention forms coatings of the powder on the surfaces of sintered magnet bodies by conducting the above-mentioned slurry coating on the sintered magnet bodies which have been warmed or heated beforehand as described above, and drying the resulting sintered magnet bodies under heat to remove the solvent from the slurry. Here, although not particularly limited, it is preferred to conduct the warming or heating before the slurry coating and the drying under heat after the slurry coating by radiating infrared rays, especially by radiating near infrared rays of 0.8 to 5 μm wavelength.

As a heater that radiates such near infrared rays, any heater can be used insofar as it can emit near infrared rays of the above-described wavelength, and a commercially-available, infrared heater unit can be used. For example, a twin tube short-wavelength infrared heater unit made of transparent quartz glass (ZKB Series or ZKC Series) available from Heraeus Noblelight GmbH or the like can be used. As warming or heating conditions and drying conditions, the output of the heater, the heating time, the cooling time and the like can be suitably set according to the size and shape of the sintered magnet bodies, the concentration of the slurry, the room temperature, and so on.

Radiation of near infrared rays can heat an object very efficiently. If near infrared rays are used to dry a slurry, however, vapor cannot be carried away. It is, therefore, preferred to remove solvent vapor from around the sintered magnet bodies by suitable exhaust means or the like, whereby more efficient drying can be conducted.

Figure 2:
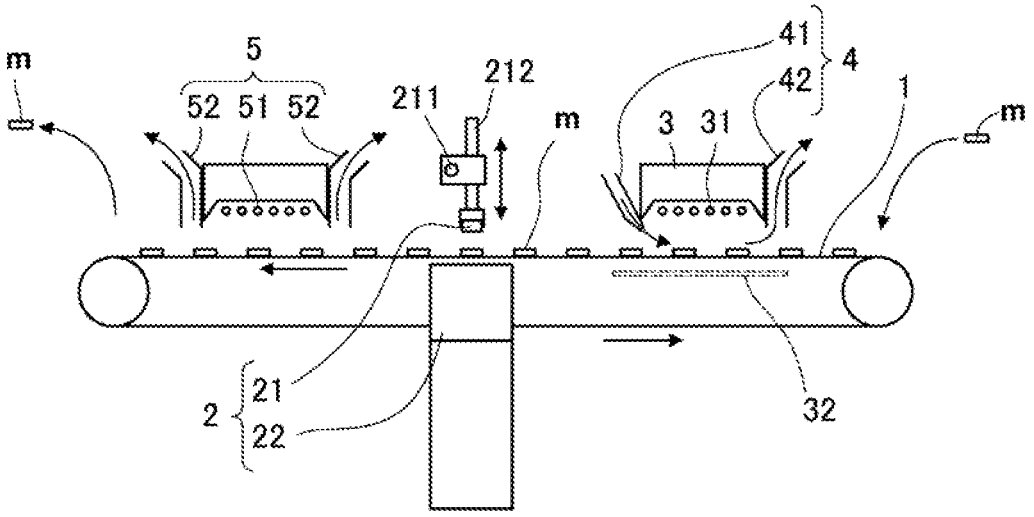
FIG. 2 is a schematic side view illustrating the coating device.
Figure 3:
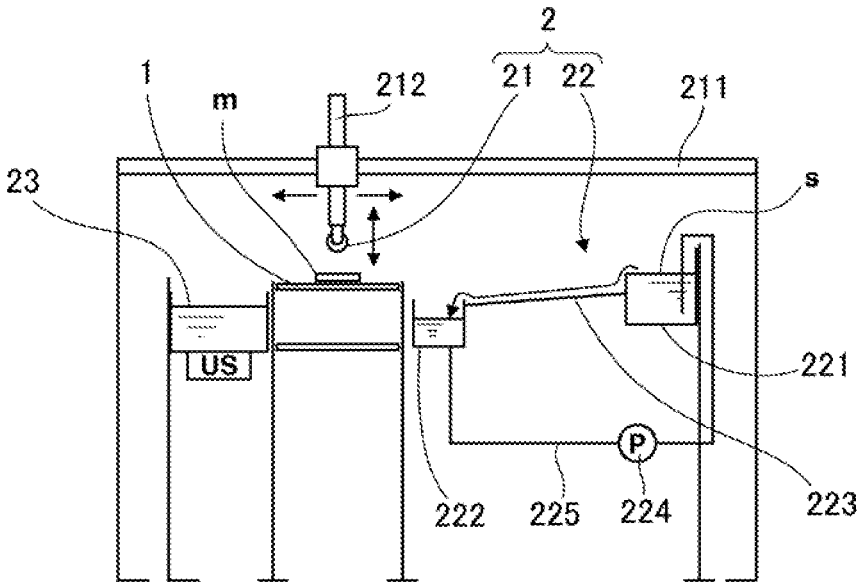
FIG. 3 is a schematic view illustrating slurry coating means that constitutes the coating device.

The powder coating steps of warming or heating the sintered magnet bodies beforehand, coating the sintered magnet bodies with the slurry, and drying the resulting sintered magnet bodies can be conducted using, for example, a coating device illustrated in FIGS. 1 to 3.

Specifically, FIGS. 1 to 3 are schematic views illustrating the coating device according to an embodiment of the present invention for coating application of the one or more rare earth compounds. This coating device applies the above-described slurry onto only one sides of rectangular block, sintered magnet bodies by roll coating. In these figures, numeral 1 designates a transport conveyor, which transports the above-described sintered magnet bodies m placed thereon. The transport conveyor is intermittently driven by an unillustrated drive source so that the sintered magnet bodies m placed on an upper surface thereof are intermittently and horizontally transported. The sintered magnet bodies m are fed to an upstream-side end portion (the right-side end portion in FIGS. 1 and 2) of the transport conveyor 1, and are transported. In the course of this transport, the sintered magnet bodies are warmed or heated, coated with the slurry, and dried to coat the powder of the rare earth compound or compounds. The sintered magnet bodies m coated with the powder are then collected from a downstream-side end portion (the right-side end portion in FIGS. 1 and 2) of the transport conveyor 1.

In the figures, numeral 2 indicates slurry coating means, which exists at an intermediate part of the transport conveyor 1 as viewed in the direction of the transport and coats the slurry onto upper sides of the sintered magnet bodies m placed on the transport conveyor 1. The slurry coating means 2 is provided with a coating roll 21, and a slurry feed unit 22 that impregnates the coating roll 21 with the slurry as needed.

The coating roll 21 is suspended from a horizontal shaft 211 and a vertical shaft 212, and as indicated by arrows in the figures, is movable in a horizontal direction and a vertical direction above the transport conveyor 1 at the intermediate part thereof as viewed in the direction of the transport.

The slurry feed unit 22 includes a slurry overflow tank 221 and a slurry receiving tank 222 connected each other via a shallow slurry feed tray 223, exists at a position where the coating roll 21 is disposed, and is disposed close to one side of the transport conveyor 1. The plane of a top opening of the slurry overflow tank 221 is arranged at a position higher than the plane of a top opening of the slurry receiving tank 222. A slurry s which has overflowed from the slurry overflow tank 221 flows into the slurry receiving tank 222 via the slurry feed tray 223, and the slurry s is returned from the slurry receiving tank 222 to the slurry overflow tank 221 by a pump 224 and a return pipe 225. The slurry feed unit 22 is, therefore, configured to circulate the slurry s. At this time, a slurry pool that is slowly flowing in a laminar form is formed in the slurry feed tray 223.

Through horizontally and vertically movements of the coating roll 21, the roll portion is dipped in the slurry feed tray 223 to impregnate the coating roll 21 with the slurry s. The coating roll 21 then moves again horizontally and vertically to return to above the transport conveyor 1, and coats some of the sintered magnet bodies m on the transport conveyor 1 with the slurry by roll coating. Numeral 23 in the figures designates an ultrasonic cleaner, which exists at the position where the coating roll 21 is disposed and is disposed close to the other side of the transport conveyor 1. The coating roll 21 is cleaned by the ultrasonic cleaner as needed, thereby avoiding uneven slurry coating that would otherwise occur by deposition of the powder. This cleaning of the roll is generally conducted during a pause of the coating operation.

No particular limitation is imposed on the coating roll 21, and the coating roll 21 can be chosen from known rolls such as so-called coating rolls with various bristles, hair, wire or the like planted thereon, sponge rolls, rubber rolls, resin rolls and metal rolls. In this embodiment, a sponge roll is adopted for its readily impregnation with the slurry and its easy periodical cleaning. The width of the roll may be set as desired according to the size and shape of the sintered magnet bodies m. To further ensure uniform slurry coating, the width of the roll may be set preferably at 10 to 300 mm, more preferably 30 to 100 mm.

In the figures, numeral 3 designates preheater means, which exists more upstream than the slurry coating means 2 as viewed in the direction of the transport and is disposed over the transport conveyor 1. The preheater means 3 radiates infrared rays to the sintered magnet bodies m on the transport conveyor 1 by an infrared heater 31 to warm or heat the sintered magnet bodies m to the above-mentioned predetermined temperature.

In a downstream-side proximity of the preheater means 3, an air knife 41 is disposed, and in a downstream-side proximity of the preheater means 3, a dust collecting duct 42 is disposed. The air knife 41 blows a laminar air flow against the sintered magnet bodies m transported under the preheater means 3, and removes dust and the like stuck on surfaces of the sintered magnet bodies m. The dust collecting duct 42 draws an air flow containing the dust and the like so removed, and remove them from the upper surface of the transport conveyor 1. With these air knife 41 and dust collecting duct 42, cleaning means 4 that cleans the surfaces of the sintered magnet bodies m is configured.

In the figures, numeral 5 indicates dryer means, which exists on a side downstream of the slurry coating means 2 as viewed in the direction of the transport, is disposed over the transport conveyor 1, and is configured of an infrared heater 51 and exhaust ducts 52 disposed on upstream and downstream sides of the infrared heater 51. The dryer means 5 radiates infrared rays from the infrared heater 51 to the sintered magnet bodies m on the transport conveyer 1 to heat the sintered magnet bodies m, so that the solvent is evaporated and removed from the slurry coated on the sintered magnet bodies m to deposit the powder of the rare earth compound or compounds. At this time, the evaporated solvent is evacuated through the exhaust ducts 52, whereby the vaporized solvent is removed from around the sintered magnet bodies m to effectively conduct drying.

Here, the infrared heaters 31 and 51 that constitute the preheater means 3 and dryer means 5 may preferably be, but are not limited to, those which radiate near infrared rays of 0.8 to 5 μm wavelength. In the device of this embodiment, twin tube short-wavelength infrared heater units made of transparent quartz glass (ZKB 1500/200G, with cooling fan, output: 1,500 W, heated length: 200 mm) available from Heraeus Noblelight GmbH are used as both the infrared heaters 31 and 51.

These heaters can radiate short-wavelength infrared rays of 0.8 to 5 μm wavelength, have a fast temperature rise, can begin effective heating in one to two seconds, can heat to 100° C. in ten seconds, and can warm or heat the sintered magnet bodies in an extremely short time. In addition, these heaters can configure at lower cost than conducting induction heating, and are also advantageous from the standpoint of power consumption. Furthermore, according to the radiation heating by the radiation of near infrared rays, the near infrared rays, upon drying under heat, can be also transmitted and absorbed into the coatings of the slurry to conduct drying under heat. It is, therefore, possible to avoid, as much as possible, development of cracking which would otherwise occur because of the beginning of drying from the outer sides of the coatings as in a case that drying is conducted, for example, by blowing hot air from the outside, and to form uniform and dense coatings of the powder. In addition, the above-described heater tubes that emit near infrared rays of short wavelength are relatively small, and therefore can also contribute to the downsizing of the coating device.

When coating the slurry, in which the powder of the one or more rare earth compounds selected from the oxides, fluorides, oxyfluorides, hydroxides and hydrides of $R^2$ ($R^2$ is one or more elements selected from rare earth elements including Y and Sc) (the powder of the one or more rare earth compounds) is dispersed in the solvent, to the surfaces of the sintered magnet bodies m by using the coating device, the sintered magnet bodies m are fed to the upstream-side end portion of the transport conveyor 1, and are intermittently transported in a horizontal direction by the transport conveyor 1.

To the sintered magnet bodies m which are placed on the transport conveyor 1 and are being transported intermittently and horizontally, infrared rays are radiated from the infrared ray heater 31 of the preheater means 3 to warm and heat them to the above-mentioned predetermined temperature when they are intermittently stopped under the preheater means 3. At this time, dust and the like on the surfaces of the sintered magnet bodies m are removed by the cleaning means 4 as mentioned above. Therefore, the sintered magnet bodies m are warmed and heated, and at the same time their surfaces are cleaned.

When the sintered magnet bodies m warmed or heated beforehand to the predetermined temperature by the preheater means 3 have then intermittently been moved to and stopped under the coating roll 21 of the slurry coating means 2, the slurry s is coated onto the surfaces of the sintered magnet bodies m by vertically and horizontally movements of the coat roll 21. At this time, the coating roll 21 is fed and impregnated with the slurry s through the above-mentioned procedures by the slurry feed unit 22 as needed, so that the slurry s is ensured to be coated in a constant amount every time.

The sintered magnet bodies m coated with the slurry s are then intermittently transported to below the dryer means 5 and stopped there. Infrared rays are radiated from the infrared heater 51 of the dryer means 5 to heat and dry the coated sintered magnet bodies m. The solvent is evaporated from the slurry s to deposit the powder, so that coatings of the powder are formed on the surfaces of the sintered magnet bodies m. The solvent evaporated and vaporized at this time is evacuated through the exhaust ducts 52 and is removed from around the sintered magnet bodies m, and therefore the above-described drying processing is efficiently conducted.

After the drying, the sintered magnet bodies m are horizontally transported further, and are collected by a worker, a robot arm or the like at the downstream-side end portion of the transport conveyor 1.

Here, by repeating a plurality of times the operation of feeding the sintered magnet bodies m, which have been collected from the downstream-side end portion of the transport conveyor 1, back to the upstream-side end portion of the transport conveyor 1 and coating them with the one or more rare earth compounds, the powder of the rare earth compound or compounds can be coated repeatedly. As a consequence, thicker coatings can be obtained with further improved uniformity. For the repetition of the coating operation, the coating processing may be repeated a plurality of times by using the same coating device, or plural coating devices may be arranged one after another to repeat the coating operation. In this manner, recoating can be conducted to obtain coatings of a desired thickness, and therefore the coat weight of the powder can be well adjusted. The repeated coating of thin layers makes it possible to shorten the drying time and hence to improve the time efficiency. In repeating the coating operation as described above, it is not absolutely necessary to conduct the preheating treatment every time. After the preheating treatment is conducted, the slurry coating and drying operation may be repeated a plurality of times.

When desired to conduct the coating of the powder to both the front and back sides of each sintered magnet body m, each sintered magnet body m collected at the downstream-side end portion of the transport conveyor 1 may be turned upside down by a worker, a robot arm or the like, may be fed back to the upstream-side end portion of the transport conveyor 1, and may then be coated similarly. Also in this case, the coating processing of both the front and back sides may be conducted using the same coating device, or a coating device for front sides and a coating device for back sides may be arranged one after another to conduct the coating operations of both the front and back sides. Needless to say, the above-described recoating may be applied to each of the front and back sides.

As described above, according to the production method of the present invention in which the coating of the powder of the rare earth compound or compounds is conducted using the above-described coating device, the sintered magnet bodies m are warmed or heated to the predetermined temperature before coating them with the slurry, the warmed or heated sintered magnet bodies m are coated with the slurry s, and the coated, sintered magnet bodies m are then dried to form coatings of the powder of the rare earth compound or compounds. By warming the sintered magnet bodies m beforehand, drying can be completed in an extremely short time upon drying under heat after the slurry coating. With the dryer means 5 included in the device of this embodiment and relying upon radiation of infrared rays, the solvent in the slurry can be evaporated and dried almost instantaneously, so that uniform coatings can be efficiently and surely formed without dripping of the slurry s to side surfaces where increased coercivity is not needed.

Described specifically, the device of this embodiment applies the slurry s by roll coating, so that a coating can be locally formed at each necessary location on the surface of each sintered magnet body m by locally coating the slurry to the necessary location only. It is, therefore, possible to effectively reduce the treatment amount of the powder of the valuable rare earth compound or compounds. According to the present invention, the drying after the slurry coating can be completed in an extremely short time as described above. Therefore, the present invention can avoid, as much as possible, dripping of the slurry to side surfaces and like where increased coercivity is not needed, can avoid wasteful consumption of the powder of the valuable rare earth compound or compounds, and can extremely efficiently achieve an increase in coercivity.

In this embodiment, the preheating (prewarming) before the slurry coating and the drying under heat after the slurry coating are conducted by radiation heating that radiates short-wavelength, near infrared rays of 0.8 to 5 μm wavelength. It is, therefore, possible to efficiently conduct the preheating (prewarming) and the drying under heat in a short time, to surely obtain uniform coatings from the powder without developing cracking or the like, and moreover to achieve downsizing of the coating device.

Described specifically, the infrared heaters 31 and 51 that radiate short-wavelength, near infrared rays have a fast temperature rise, and can complete heating or warming in an extremely short time. Further, it can be configured at lower cost than conducting induction heating, and it is also advantageous from the standpoint of power consumption. It is hence possible to conduct the coating of the powder by efficiently warming or heating the sintered magnet bodies m and drying the slurry s at lower cost. Furthermore, according to the drying processing through radiation heating by the radiation of near infrared rays, the near infrared rays can be also transmitted and absorbed into the coatings of the slurry to conduct heating or warming. It is, therefore, possible to avoid, as much as possible, development of cracking which would otherwise occur because of the beginning of drying from the outer sides of the coatings as in a case that warming/heating and drying are conducted, for example, by blowing hot air from the outside, and to form uniform and dense coatings of the powder. In addition, the above-described heater tubes that emit near infrared rays of short wavelength are relatively small, and therefore can downsize the dryer or the coating device. Therefore, rare earth magnets can be efficiently produced by small-scale facilities.

It is to be noted that the coating device according to the present invention is not limited to the above-described device of FIGS. 1 to 3. For example, a belt conveyor is illustrated as the transport conveyor 1 in the figures, but a roller conveyor may also be used. Further, as illustrated by dot-dash lines in FIG. 2, a reflection sheet 32 may be arranged on a back side of the conveyor to reflect infrared rays, so that the sintered magnet bodies m can be warmed or heated more efficiently. Furthermore, the device of FIGS. 1 to 3 is configured to conduct roll coating with the coating roll 21. In some cases, however, the device may be configured to conduct spray coating or dip coating. Concerning other to elements such as the preheater means 3, dryer means 5 and slurry feed unit 22, modifications may also be applied as needed within a scope not departing from the spirit of the present invention.

According to the production method of the present invention, the sintered magnet bodies which have been coated with the powder as described above are subjected to heat treatment to cause absorptive diffusion of the rare earth element or elements represented by $R^2$ and contained in the powder. The heat treatment, which causes absorptive diffusion of the above-described rare earth element or elements represented by $R^2$, can be conducted by a known method. After the above-described heat treatment, known post-treatment can be applied as needed, for example, aging treatment can be applied under appropriate conditions, and further the resulting rare earth magnets can be ground into a practical shape.

EXAMPLES

About more specific aspects of the present invention, a detailed description will hereinafter be made based on Examples. It should, however, be noted that the present invention shall not be limited to the Examples.

Examples 1 to 4 and Comparative Example

An alloy in thin plate form was prepared by a strip casting technique, specifically by weighing Nd, Al, Fe and Cu metals having a purity of at least 99 wt %, Si having a purity of 99.99 wt %, and ferroboron, high-frequency heating in an argon atmosphere for melting, and casting the alloy melt on a copper single roll. The alloy consisted of 14.5 at % of Nd, 0.2 at % of Cu, 6.2 at % of B, 1.0 at % of Al, 1.0 at % of Si, and the balance of Fe. Hydrogen decrepitation was carried out by exposing the alloy to 0.11 MPa of hydrogen at room temperature to occlude hydrogen and then heating at 500° C. for partial dehydriding while evacuating to vacuum. The decrepitated alloy was cooled and sieved, yielding a coarse powder under 50 mesh.

The coarse powder was finely pulverized into a powder having a weight median particle size of 5 μm in a jet mill that used high-pressure nitrogen gas. The resulting mixed fine powder was formed into block-shaped compacts under a pressure of approximately 1 ton/cm$^2$ while allowing its particles to orient in a magnetic field of 15 kOe under a nitrogen gas atmosphere. The compacts were placed in a sintering furnace under an Ar atmosphere, and were sintered at 1,060° C. for two hours to obtain magnet blocks. After the magnet blocks were subjected to full-surface grinding with a diamond cutter, the resulting magnet blocks were cleaned with an alkaline solution, deionized water, nitric acid, and deionized water in this order, followed by drying to obtain block-shaped magnet bodies of 20 mm×45 mm×5 mm (in the direction of magnetic anisotropy).

Next, a powder of dysprosium fluoride was mixed at a mass fraction of 40% in water, followed by thorough dispersion of the powder of dysprosium fluoride to prepare a slurry. Using the above-described coating device illustrated in FIGS. 1 to 3, the above-described magnet bodies were coated with the slurry, and the resulting magnet bodies were dried to deposit the powder of dysprosium fluoride. At this time, the powder coating processing was conducted by varying the temperature of the preheating (prewarming) in the preheater means 3 as indicated in FIG. 1 (Examples 1 to 4). In addition, as a Comparative Example, similar powder coating processing was conducted without any preheating (prewarming) in the preheater means 3 (Comparative Example). In all the Examples and Comparative Example, collected sintered magnet bodies were subjected again to coating processing, whereby recoating was conducted three times. In Examples 1 to 4, the slurry coating processing and drying processing were repeated three times, but the preheating processing was limited to only once in the first round of the slurry coating processing and drying processing.

From the entire coated surface of each sintered magnet body so obtained, powder was removed with a scraper, and its weight was measured. Assuming that the coat weight at which the increasing effect for coercivity reaches the peak is 1.00, the proportions of coat weights per unit area are presented in Table 1.

TABLE 1

| | Heating before coating | Proportion of coat weight on coated surface |
|---|---|---|
| Comparative Example | No heating | 0.72 |
| Example 1 | 30° C. | 0.89 |
| Example 2 | 40° C. | 0.97 |
| Example 3 | 60° C. | 1.01 |
| Example 4 | 80° C. | 1.03 |

As appreciated from Table 1, the prewarming or preheating of sintered magnet bodies has been confirmed to lead to an increase in the coat weight of the powder owing to the formation of coatings through prompt drying of the solvent without dripping of the slurry to surfaces other than the surfaces to be coated. In contrast, the coat weight in the Comparative Example was small although roll coating was conducted similarly. This can be attributed to dripping of as much the slurry as the decrease in the coat weight to side surfaces of the sintered magnet bodies.

Example 5

Figure 4:
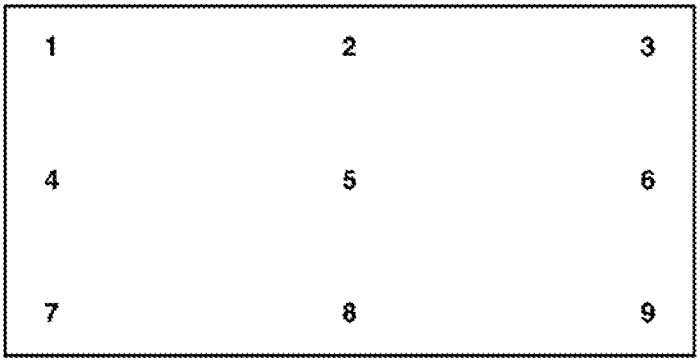
FIG. 4 is an explanatory diagram representing measurement positions on a rare earth magnet in an Example.

A magnet body with a coating of a powder of dysprosium fluoride formed thereon in a similar manner as in Example 3 was subjected to heat treatment at 900° C. for five hours in an Ar atmosphere, and was then subjected to aging treatment at 500° C. for one hour, followed by quenching to obtain a rare earth magnet. Magnet bodies of 2 mm×2 mm×2 mm were cut out from the nine points indicated in FIG. 4, and were then measured for coercivity. The results are presented in Table 2.

TABLE 2

| | Increase in coercivity (unit: KA/m) | | | | | | | | |
|---|---|---|---|---|---|---|---|---|---|
| | 1 | 2 | 3 | 4 | 5 | 6 | 7 | 8 | 9 |
| Example 5 | 480 | 475 | 460 | 480 | 480 | 470 | 480 | 480 | 480 |

As appreciated from Table 2, the preheating of magnet bodies before coating can uniformly deposit and form coatings of the powder without dripping of the slurry to surfaces other than the surfaces to be coated, and moreover the roll coating can promote homogenization within coatings, and can effectively use the expensive rare earth compound or compounds without waste. In addition, the increasing effect for coercivity at the coated surfaces is free of irregularity and is very stable.

REFERENCE SIGNS LIST

1 transport conveyor
2 slurry coating means
21 coating roll
211 horizontal shaft
212 vertical shaft
22 slurry feed unit
221 slurry overflow tank
222 slurry receiving tank
223 slurry feed tray
224 pump
225 return pipe
23 ultrasonic cleaner
3 preheater means
31 infrared heater
32 reflection sheet
4 cleaning means
41 air knife
42 dust collecting duct
5 dryer means
51 infrared heater
52 exhaust duct
m sintered magnet body
s slurry

The invention claimed is:

1. A method for producing rare earth magnets, the method comprising the steps of:

providing sintered magnet body of an $R^1$—Fe—B composition, where $R^1$ is one or more elements selected from the group consisting of Y, Sc, La, Ce, Pr, Nd, Sm, Eu, Gd, Tb, Dy, Ho, Er, Yb and Lu, and a slurry comprising a solvent and a powder of one or more compounds selected from oxides, fluorides, oxyfluorides, hydroxides and hydrides of $R^2$, where $R^2$ is one or more elements selected from the group consisting of Y, Sc, La, Ce, Pr, Nd, Sm, Eu, Gd, Tb, Dy, Ho, Er, Yb and Lu, dispersed in the solvent;

warming or heating the sintered magnet body by a near infrared ray of 0.8 to 5 μm wavelength, such that the sintered magnet body is warmed or heated up to a temperature lower by 20° C. than a boiling point of the solvent in the slurry, before applying the slurry to the sintered magnet body;

after the warming or heating the sintered magnet body, applying the slurry to surfaces of the sintered magnet body so that the slurry directly covers the surfaces of the sintered magnet body;

drying the resulting sintered magnet body by a near infrared ray of 0.8 to 5 μm wavelength to remove the solvent from the slurry and to deposit the powder from the slurry on the surfaces of the sintered magnet body, such that the sintered magnet body, the surfaces of which are coated by the powder, are obtained; and then subjecting the obtained sintered magnet body covered with the powder to heat treatment to cause absorption of $R^2$ into the sintered magnet body, wherein the slurry is applied on the surfaces of the sintered magnet body by supplying the slurry to a slurry feed tray, dipping a coating roll in the slurry on the slurry feed tray to impregnate the coating roll with the slurry, and moving horizontally the coating roll toward the sintered magnet body and then moving down the coating roll to the sintered magnet body on a transport conveyor, so that the slurry is applied to the sintered magnet body by the coating roll, and the method further comprises a step of transporting the sintered magnet body on the transport conveyor, wherein the steps of warming or heating the sintered magnet body, applying the slurry to the sintered magnet body, and drying the resulting sintered magnet body are conducted while the sintered magnet body is held on the transport conveyor.

2. The production method of claim 1, wherein the solvent in the slurry is water, and in the step of warming or heating, the sintered magnet body is warmed or heated to 40° C. to 80° C.

3. The production method of claim 1, wherein the steps of warming or heating the sintered magnet body, applying the slurry to the sintered magnet body, and drying the resulting sintered magnet body are repeated a plurality of times to conduct recoating.

4. The production method of claim 1, wherein the heat treatment is applied to the sintered magnet body, which has been coated with the powder, in vacuo or in an inert gas at a temperature up to a sintering temperature for the sintered magnet body.

5. The production method of claim 1, further comprising:

applying, after the heat treatment, aging treatment at a temperature lower than a temperature of the heat treatment.

6. The production method of claim 1, wherein the solvent in the slurry is at least one solvent selected from the group consisting of water, ethanol, acetone, methanol, and isopropanol.

7. The production method of claim 1, wherein the solvent vaporized from the slurry by the near infrared ray in the step of drying is exhausted by exhaust means from around the sintered magnet body on the transport conveyor.

8. The production method of claim 1, further comprising the steps of:

blowing a laminar air flow to the sintered magnet body on the transport conveyor to remove dust from the surfaces of the sintered magnet body and collecting the dust, before applying the slurry to the sintered magnet body.

9. The production method of claim 1, further comprising the steps of:

blowing a laminar air flow by an air knife to the sintered magnet body on the transport conveyor to remove dust from the surfaces of the sintered magnet body and collecting the dust by a dust collection duct, before applying the slurry to the sintered magnet body, wherein the step of warming or heating the sintered magnet body is conducted by a preheater to generate the near infrared ray of 0.8 to 5 μm wavelength, and the air knife and the dust collection duct are disposed interposing the preheater, so that the dust blown by the air knife is collated by the dust collection duct.

10. The production method of claim 1, further comprising the steps of:

allowing the slurry to overflow from a slurry overflow tank to the slurry feed tray and flow from the slurry feed tray to a slurry receiving tank, and returning the slurry from the slurry receiving tank to the slurry overflow tank, so that the slurry recycles from the slurry overflow tank to the slurry receiving tank via the slurry feed tray.

* * * * *